US006935262B2

(12) United States Patent
Roodenburg et al.

(10) Patent No.: US 6,935,262 B2
(45) Date of Patent: Aug. 30, 2005

(54) METHOD FOR LOWERING AN OBJECT TO AN UNDERWATER INSTALLATION SITE USING AN ROV

(75) Inventors: Joop Roodenburg, Delft (NL); Jacobus Hoogewerff, Roosendaal (NL)

(73) Assignee: Itrec B.V., (NL)

( * ) Notice: Subject to any disclaimer, the term of this patent is extended or adjusted under 35 U.S.C. 154(b) by 7 days.

(21) Appl. No.: 10/766,251

(22) Filed: Jan. 28, 2004

(65) Prior Publication Data

US 2005/0160959 A1 Jul. 28, 2005

(51) Int. Cl.[7] ..... B63B 35/44
(52) U.S. Cl. ..... 114/258; 405/191
(58) Field of Search ..... 114/258, 322; 405/191

(56) References Cited

U.S. PATENT DOCUMENTS 4,010,619 A * 3/1977 Hightower et al. ..... 405/191
4,721,055 A * 1/1988 Pado ..... 405/191
5,069,580 A 12/1991 Herwig ..... 405/191
5,190,107 A 3/1993 Langner ..... 166/355
6,148,759 A * 11/2000 Taylor, Jr. ..... 114/312
6,588,985 B1 7/2003 Bernard ..... 405/191

FOREIGN PATENT DOCUMENTS

GB 2277949 12/1994 ..... B63B 35/44

* cited by examiner

*Primary Examiner*—Jesus D. Sotelo
(74) *Attorney, Agent, or Firm*—Buskop Law Group, P.C.; Wendy Buskop

(57) ABSTRACT

The method for lowering an object to an underwater installation site, wherein a submersible remotely operated vehicle (ROV) having at least one thruster for providing lateral thrust is interconnectable to an object, entails providing a vessel, having a winch and suspension cable; interconnecting and lowering the object and ROV towards the underwater installation site using a suspension cable, providing at least one anchor near the installation site; interconnecting each anchor and ROV with a positioning wire, while the ROV and object are suspended in the holding position; tensioning and adjusting the length of each positioning wire such that the interconnected ROV and object are positioned with respect to the installation site; and further lowering interconnected object and ROV, which are positioned by at least one positioning wire onto the installation site while keeping the interconnected object and ROV suspended from a suspension cable.

29 Claims, 12 Drawing Sheets

METHOD FOR LOWERING AN OBJECT TO AN UNDERWATER INSTALLATION SITE USING AN ROV

FIELD

The present invention relates to methods for lowering an object to an underwater installation site wherein use is made of a submersible remotely operated vehicle or ROV as it is known in the art. The present invention also relates to an ROV suitable for use in at least one of these methods.

BACKGROUND

Prior art developments in the field of underwater installation of objects found in the offshore oil and gas industries have primarily relied on guide wires extending from the installation site to the water surface in order to accurately position the object on the installation site.

In deepwater, in depths of several hundreds or even thousands of meters, guide wires are no longer practical. In U.S. Pat. No. 6,588,985, a load carrying ROV has been proposed to lower large heavy objects and position them at an underwater installation site without the use of guide wires.

It is also known for deepwater installation to use a deepwater crane and position the object onto the installation site using a free-swimming ROV.

OBJECT

The invention aims to provide improved methods for lowering an object to an underwater installation site using an ROV.

In particular, a first aspect of the present invention aims to provide a method that allows for an accurate and reliable positioning of the object onto the installation site. The accurate and reliable positioning is completed, even if installation takes places in extreme conditions such as deepwater, high currents, and adverse surface wave conditions.

A second aspect of the invention aims to provide an improved method that allows for the lowering of an object using the ROV that allows for greater economics when carrying out the operation, while being less influenced by wave conditions and less dependent on a large vessel for handling the ROV if the object to be handled is large and/or heavy.

The methods according to the invention are suitable for all sorts of activities, such as: template installation, wellhead installation, jumper installation, tie-ins, pile handling, pile positioning, mattress installation or combinations thereof.

SUMMARY

According to the first aspect of the invention, a method is proposed for lowering an object to an underwater installation site, wherein use is made of a submersible remotely operated vehicle (ROV) having one or more thrusters for providing at least lateral thrust. The ROV is interconnectable to the load.

The method comprises providing a vessel, preferably a surface vessel, having a winch and an associated suspension cable, interconnecting the object and ROV. The method entails lowering the interconnected object and ROV towards the underwater installation site using a suspension cable. The interconnected object and ROV are in a freely suspended state. The lateral motion of the interconnected object and ROV is controlled using the thrusters of the ROV. Lowering is continued until a holding position is reached in which the interconnected object and ROV are held suspended by the suspension cable at a distance above the installation site.

One or more anchors are provided near the installation site. The ROV is connected to an anchor with an associated positioning wire, while the ROV and object are suspended in the holding position. One or more positioning wires are tensioned and the length of the positioning wires are adjusted such that the interconnected ROV and object are brought to a correct position with a stable orientation with respect to the installation site.

The method continues by lowering of the interconnected object and ROV, which are positioned by positioning wires, onto the installation site while keeping the interconnected object and ROV suspended from the suspension cable.

The object can be designed to be installed "permanently" at the installation site, so that the object and the ROV are disconnected once the object is installed. After the disconnection, the ROV and, possibly, the anchors are retrieved. The method is intended to be used for a rather short period at the installation site, such as for performing a flowline tie-in operation. For such operations, the accurate positioning of the tool is also very advantageous. Furthermore, the anchoring winches could be employed to provide a force required for the operation, such as for affecting the tie-in.

The anchor can be of the type that can hold onto the seabed, such as a pile driven into the seabed. It is also possible that the anchor is a piece of equipment or the like already installed on the seabed, such a template already installed on the seabed.

Preferably, multiple anchors are provided at distinct locations and each anchor is connected to the ROV using an associated positioning wire. For example, three or four anchors are arranged at various locations around the installation site, so that ROV and object can be positioned accurately.

Preferably, the ROV is provided with a positioning winch for each positioning wire, so that by suitable operation, the positioning winch of the ROV and the object are positioned correctly.

In a preferred embodiment, the ROV is provided with position detection device (as is common in the art). Each positioning wire winch is provided with an associated control device connected to a position detection device for controlling, possibly automatically, the operation of each positioning wire winch.

The one or more anchors could be placed such that each positioning wire is oriented essentially vertical as the interconnected object and ROV are in the holding position. This allows for a reliable control of the vertical position and motion of the interconnected ROV and object. In particular, this allows for bringing the interconnected object and ROV into a state with very limited vertical motion, regardless of the wave conditions at the surface. This is even more so if a heave compensation system is associated with the suspension cable. This could well be a passive heave compensation system.

In this method, it is an option to use the one or more positioning wires to pull the ROV and object down towards the installation site while still suspended by the suspension cable. In this manner, a precise control of the descent of the object in the final stage of the installation is possible.

It is also possible to place one or more anchors such that each positioning wire is oriented essentially horizontal as the interconnected object and ROV are in the holding position. This allows for an accurate control of the position of object and ROV in the horizontal plane.

It will be apparent to the man skilled in the art that choosing the locations of the anchors will determine the orientation of the positioning wires and thus the degree of control in both horizontal and vertical directions. Depending on the circumstances, such as current conditions near the installation site, wave action, interaction of object with the installation site or combinations thereof, the man skilled in the art will be able determine a favourable placing of the anchors.

The anchor is a suction anchor, such as a suction pile anchors as generally known in the offshore industry. It is envisioned that the same ROV that handles the object to be placed on the installation site is first used for placing one or more anchors near the installation site.

It is further envisioned that a second ROV, preferably a small ROV, possibly carried along in docking station within the ROV interconnected to the object, is used for establishing the wire connection between each anchor and the ROV.

Preferably, the ROV has a remotely operable connection device for connecting and disconnecting the object and ROV.

The first aspect of the invention also relates to a submersible remotely operable vehicle, having a body, a thruster, position detection device, and further having an positioning wire winch for connection to an underwater anchor using an associated positioning wire, wherein the positioning winch has a control device and the winch control device are connected to the position detection device of the ROV.

Preferably the ROV has multiple positioning winches and each positioning wire winch has a winch control device connected to the position detection device of the ROV.

The second aspect of the present invention relates to a method for lowering an object to an underwater installation site, wherein use is made of a submersible remotely operated vehicle (ROV) having at least one thruster, which ROV is connectable to the object.

In this method according to the second aspect of the invention, the object, a template, is lowered into the water and suspended in a beneath water surface position. Independently from lowering and suspending the object, the ROV is lowered into the water and suspended in a beneath water surface position in the vicinity of the object.

Then the object and the ROV are interconnected while in the beneath water surface position, and the interconnected object and ROV are further lowered towards the installation site.

Preferably the beneath water surface position in which the interconnection takes place below the wave action zone, thus at such a depth that surface waves do not significantly affect the interconnection operation. In practice this could be a depth within the 20 and 50 meter range.

Further advantages embodiments of both aspects of the invention are disclosed in the appended claims and in the description which follows.

The man skilled in the art will understand that the first and second aspect of the invention can be used in a single installation operation.

BRIEF DESCRIPTION OF THE DRAWINGS

Aspects of the present invention will be described in greater detail with reference to the appended figures.

The present embodiments are detailed below with reference to the listed Figures.

DETAILED DESCRIPTION

Figure 1:
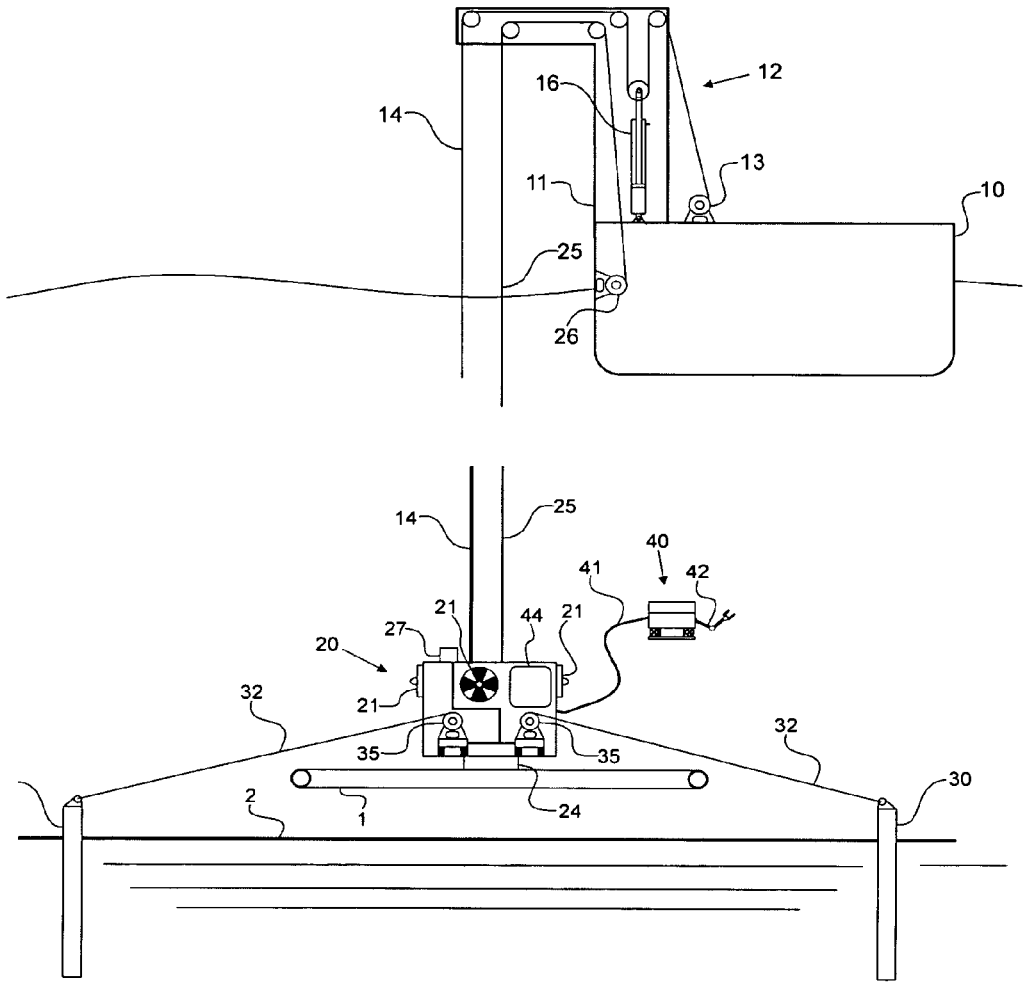
FIG. 1 depicts schematically the installation of a template onto the seabed using a method according to the first aspect of the invention.

Referring to FIG. 1, the accurate placing of a template 1 onto the seabed 2 in deepwater conditions will be explained as an example to illustrate the method of the first aspect of the present invention. It will be apparent that this method could be used in other situations. An example of such is for lowering a valve onto an already installed underwater system.

FIG. 1 shows a vessel 10, preferably a surface vessel or an semi-submersible, equipped with a hoist device 12 including a crane structure 11, a winch 13, a suspension cable 14 from which the template 1 is suspended and having a length sufficient to lower the template 1 at least close to the seabed 2.

Also shown is a submersible remotely operated vehicle 20 or ROV having multiple thrusters 21 for providing at least lateral thrust in different directions.

The ROV 20 and template 1 are non-buoyant, so that the weight of the submerged combination, which could in practice be several tons, possibly hundreds of tons, is carried by the suspension cable 14.

An umbilical 25, which could be integrated or combined with the suspension cable 14, provides a control link and possible power link between the vessel 10, which is provided with an umbilical winch 26 and the ROV 20.

The ROV 20 is provided with a connector 24 for connecting to the template 1, which connector 24 can be operated remotely in order to connect and disconnect the template 1 and the ROV 20.

Figure 2:
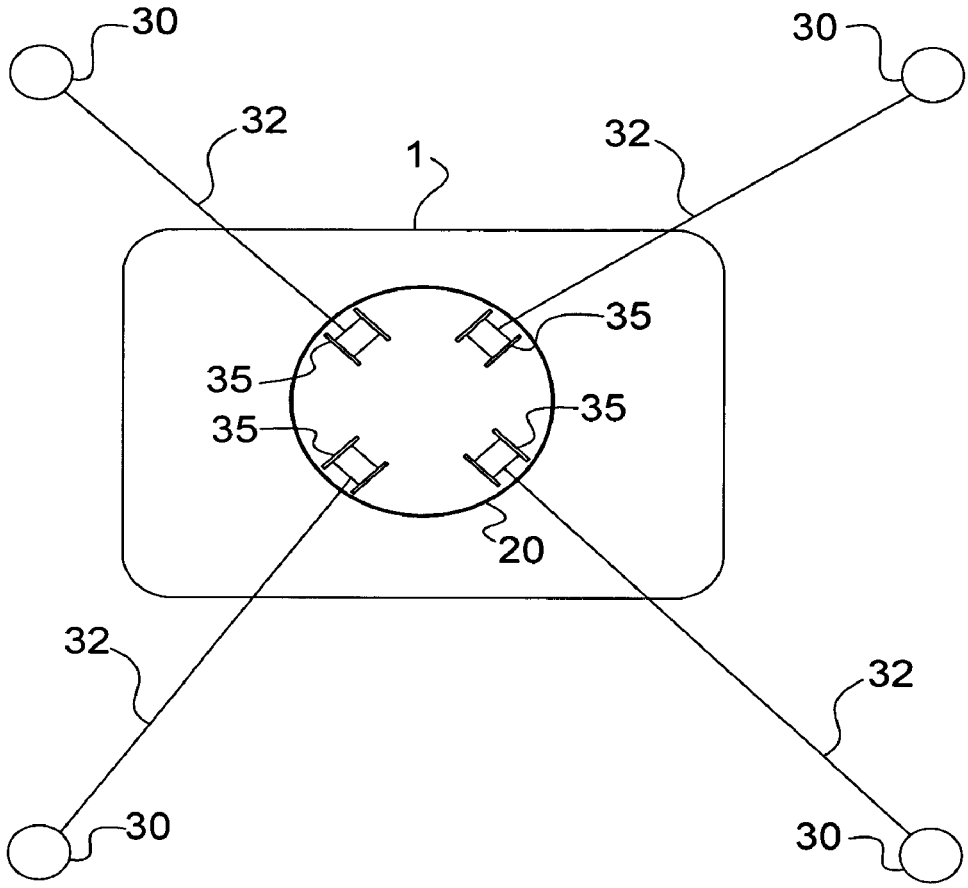
FIG. 2 depicts a plan view of the installation site of FIG. 1 with anchors, ROV, and template.

FIG. 1 and FIG. 2 depict suction pile anchors 30, in this example four in total, placed at different locations around the installation site for the template 1.

In a preferred embodiment, the ROV 20 is suitable to handle the installation of the suction piles 30 before the template 1 is lowered using the same ROV 20.

Figure 9:
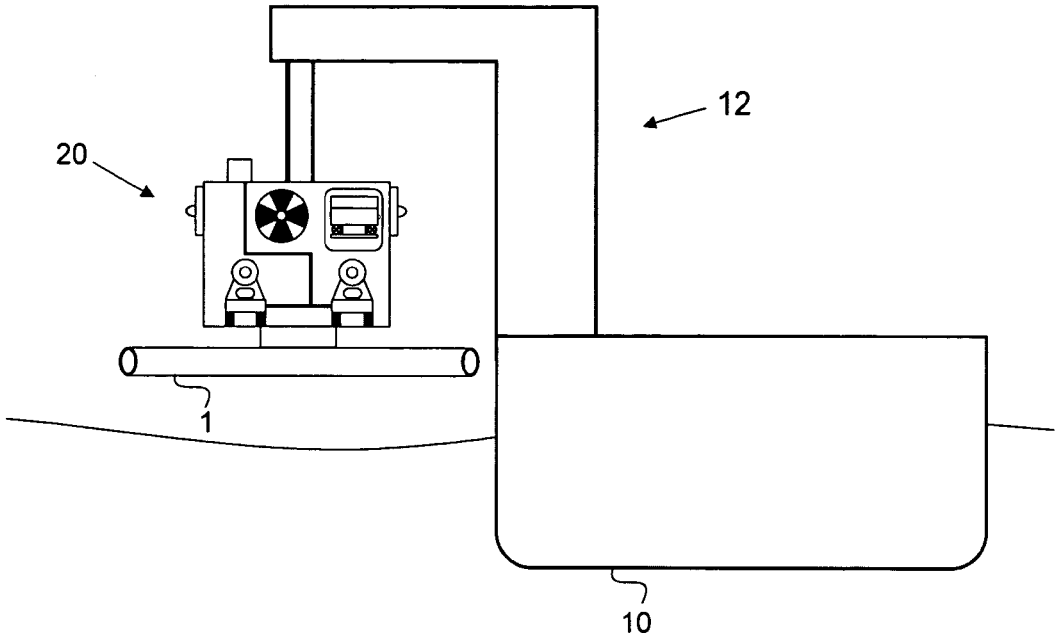
FIG. 9 depicts a schematic drawing of another method for lowering an ROV and interconnected object into the water.

In the method according to the first aspect of the invention, the template 1 and ROV 20 are interconnected. The interconnection can take place before the combination of template 1 and ROV are lowered into the water or after, as proposed by the second aspect of the present invention. A possible layout is presented in FIG. 9 showing vessel 10 interconnected to the ROV 20 and the template 1 suspended from hoist device 12 before lowering to the seabed.

The interconnected template 1 and ROV 20 are lowered towards the underwater installation site using the suspension cable 14. There are no guide wires extending from the installation site to the water surface in order to guide the combination during this, possibly lengthy, descend, so that the interconnected template 1 and ROV 20 are in a freely suspended state. Lateral motion of the template 1 and ROV 20 is controlled using the thrusters 21 of the ROV 20.

The ROV 20 is equipped with position detection equipment 27, such as a gyro-compass, ultrasonic position detection equipment, sonar, or camera.

The lowering of the combined ROV 20 and template 1 is continued by paying out suspension cable 14 until a holding position is reached. Meanwhile, the template 1 and ROV 20 are held suspended by the suspension cable 14 at a distance above the installation site (shown in FIG. 1).

In practice the vertical distance between the holding position and the installation site could well lie within the range of 2 and 50 meters.

Once this holding position is reached each anchor 30 is connected to the ROV 20 with a positioning wire 32, while the ROV 20 and template 1 remain suspended in the holding position by the cable 14.

In FIG. 1 and FIG. 2 it can be seen that the ROV 20 is provided with multiple (in this example four) positioning wire winches 35.

In order to connect the positioning wires 32 a second ROV 40 is employed. This ROV 40 could be carried along in a suitable garage 44 within the ROV 20 and connected by a tether line 41. These small type ROVs are well known in the art and have tooling 42 in order to perform various operations, such as a grab.

The positioning wires 32 are tensioned using the winches 35 in order to stabilize the motion of the combination of template 1 and ROV 20.

As can be seen in FIG. 1 the positioning wires 32 mainly extend in horizontal direction so that these wires 32 primarily provide stability in the horizontal plane, to counteract currents near the installation site. If vertical motions of the combined ROV and template should be stabilized, a more vertical orientation of the wires 32 is effective. An arrangement wherein some wires 32 are more horizontal and others are more vertical is also possible.

The vessel 1 is provided with a heave compensation system 16 associated with the suspension cable 14 in order to counteract the wave action. This system could in practice be a passive system but also an active system could be employed. In a practical embodiment the system could include a cable sheave supported by a piston rod of a compensation cylinder. Passive heave compensator systems are also well known in the art and need not to be further elaborated here.

By adjusting the length of each positioning wire 32 by device of the associated winch 35 the interconnected ROV 20 and template 1 can be positioned over the installation site with great accuracy. Then the template 1 and ROV 20 are further lowered onto the installation site while keeping the template 1 and ROV 20 suspended from the suspension cable 14.

Figure 3:
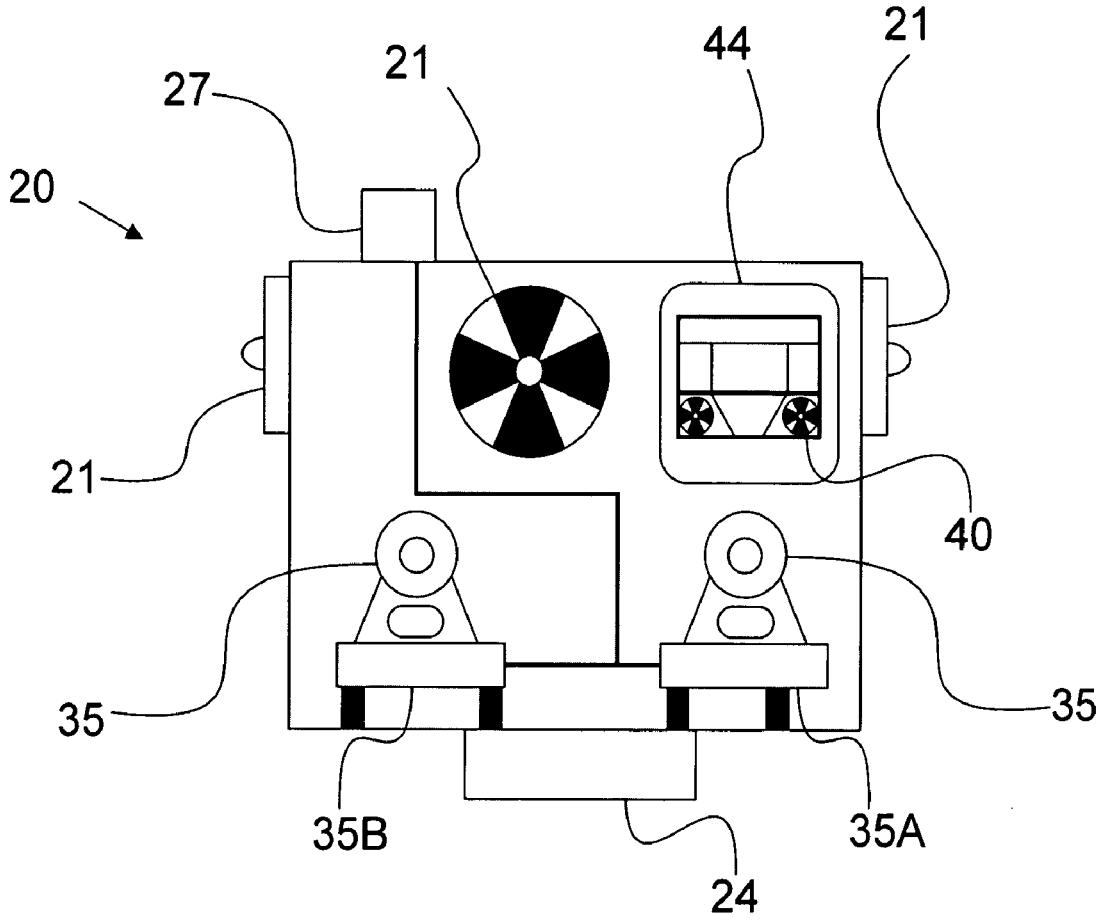
FIG. 3 depicts a schematic side view of the ROV.

As mentioned before the ROV 20 is provided with position detection equipment 27. Each positioning wire winch 35 is provided with an associated control device 35*a* connected to position detection equipment 27 for controlling the operation of each positioning wire winch 35 as shown in FIG. 3.

Figure 4:
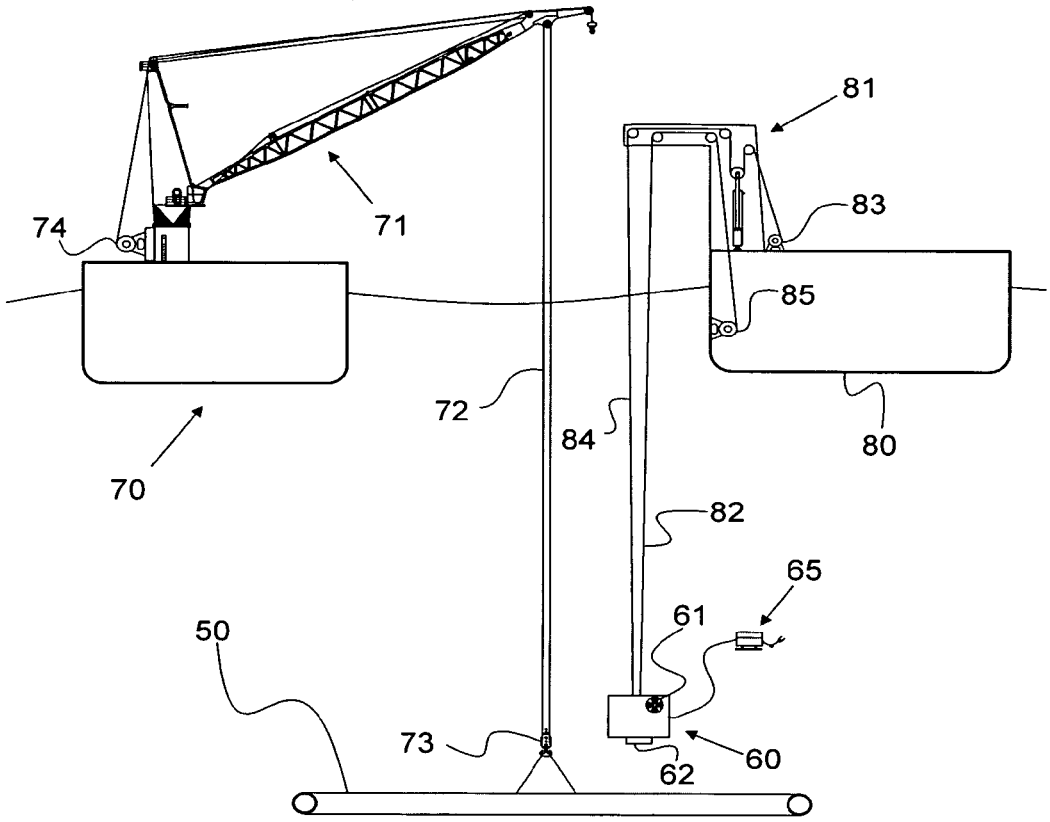
FIG. 4 depicts schematically a first practical embodiment of the method according to the second aspect of the invention.

Referring to FIG. 4 a first embodiment of the second aspect of the present invention will be discussed. According to this second aspect a method for lowering an object, in this example, a template 50 to an underwater installation site (not shown) is provided, wherein use is made of a submersible remotely operated vehicle or ROV 60 having at least one thruster 61, which ROV 60 is connectable to the template 50.

In FIG. 4 a first, large surface vessel 70 having a crane 71 is shown. The crane 71 is equipped with template suspension cable 72 in a multiple fall arrangement supporting a crane block with crane hook 73. A winch 74 is provided on the surface vessel 70 for raising and lowering the crane hook 73.

Using this crane 71 the template 50 is lifted from a transport vessel, possibly the vessel 70 itself, and lowered into the water. The template 50 is lowered until a suitable depth beneath the water surface is reached and suspend there in a beneath water surface position. Preferably this depth is such that the beneath water surface position is beneath a wave action effect zone, so that wave action does not significantly affect the stability of the template 50 in this position.

FIG. 4 depicts a second surface vessel 80 positioned in the vicinity of the first surface vessel 70. This vessel has a crane 81 or the like with an ROV suspension cable 82, an associated ROV winch 83, an ROV umbilical 84 and an ROV umbilical winch 85.

The ROV 60 is preferably transported to the site using vessel 80 and then, independent from lowering and suspending the template 50, lowered into the water using the crane 81. The ROV 60 is then suspended also in a suitable beneath water surface position, basically at similar depth as the template 50, preferably below the zone affected by wave action.

As seen in FIG. 4, the beneath water surface position is preferably at least below the draught of the vessel 70 and vessel 80, so that the template 50 and ROV 60 will not contact the vessels. This depth is preferred as the vessel 80 can be manoeuvred over a part of the submerged template 50 before the interconnection of template 50 and ROV 60 takes place.

In practice for deepwater installation operations, a suitable depth for suspending the template and ROV could be within the 20 and 40 meter range.

The next step (not shown in FIG. 4) is to interconnect the template 50 and the ROV 60 while in the beneath water surface position. This is preferably done using one or more remote controlled connectors 62 on the ROV 60 and/or using a second ROV 65 tethered from the ROV 60.

Once the ROV 60 is connected to the template 50, the template suspension cable 72 can be disconnected so that the combined unit is further lowered using the crane 81 on the vessel 80. This allows a more efficient use of the vessel 70 as it can now be used or prepared for further operations. The crane 81 on the smaller vessel 80 is adequate for lowering the combination further to the underwater installation site. As seen in FIG. 4, the crane 81 can have a reach that is insufficient to lower the template 50 into the water as the template 50 is too large.

If the template 50 or other object is too large/heavy to be handled by crane 81, the ROV cable 82 is disconnected after the interconnection and then the combined unit is lowered using the cable 72. The umbilical 84 is needed for providing electrical power to the ROV and exchange of (control) signals.

Figure 5:
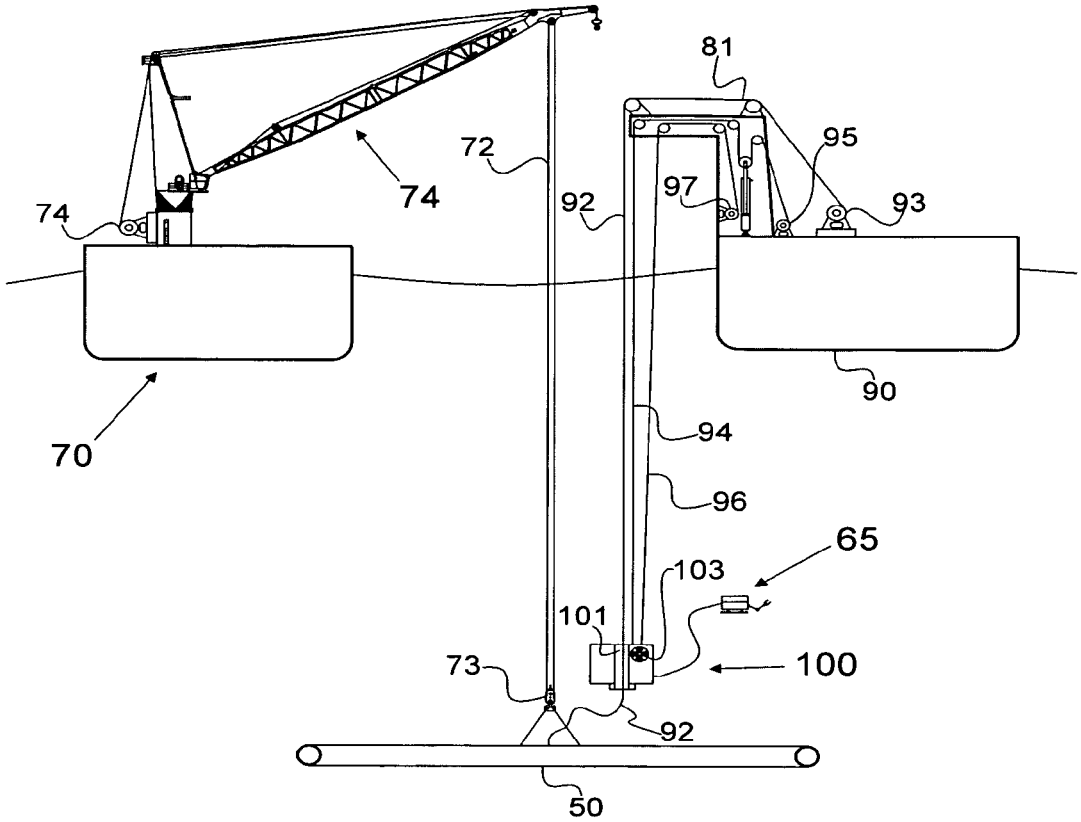
FIG. 5 through FIG. 7 depict different stages of a second practical embodiment of the method according to the second aspect of the invention.
Figure 6:
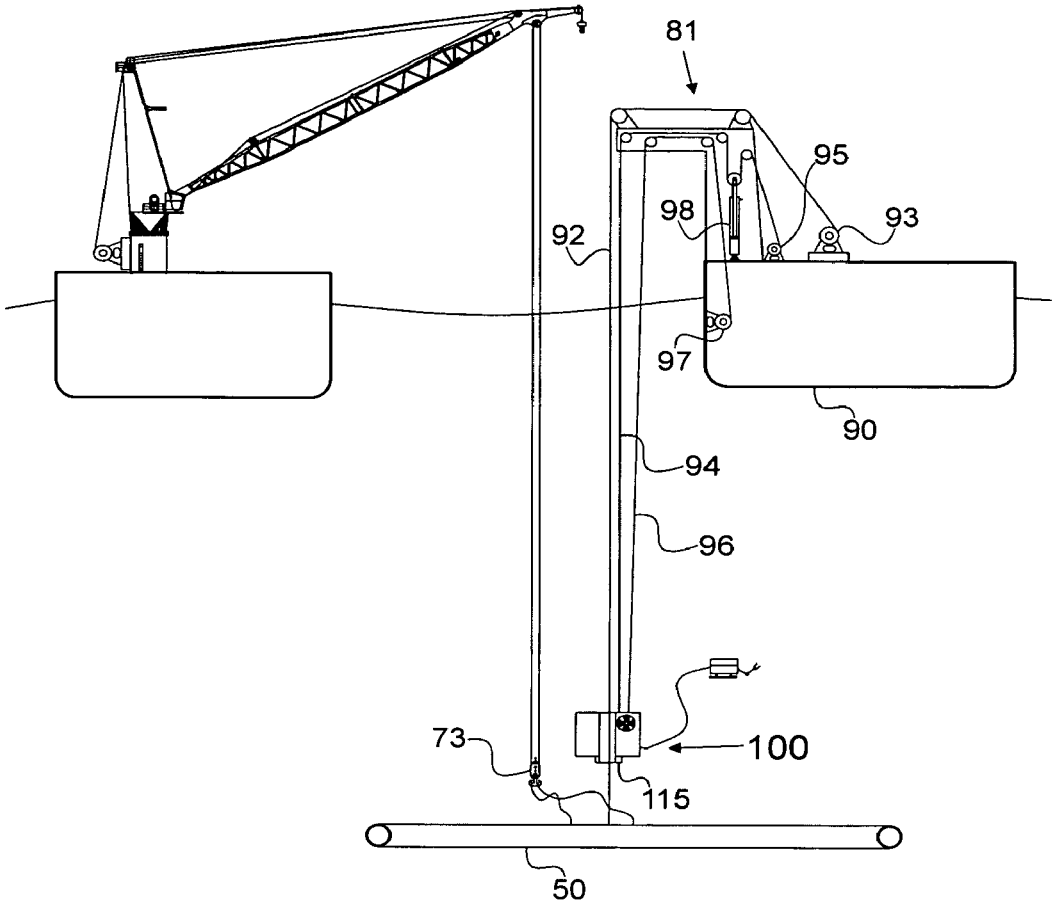
Figure 7:
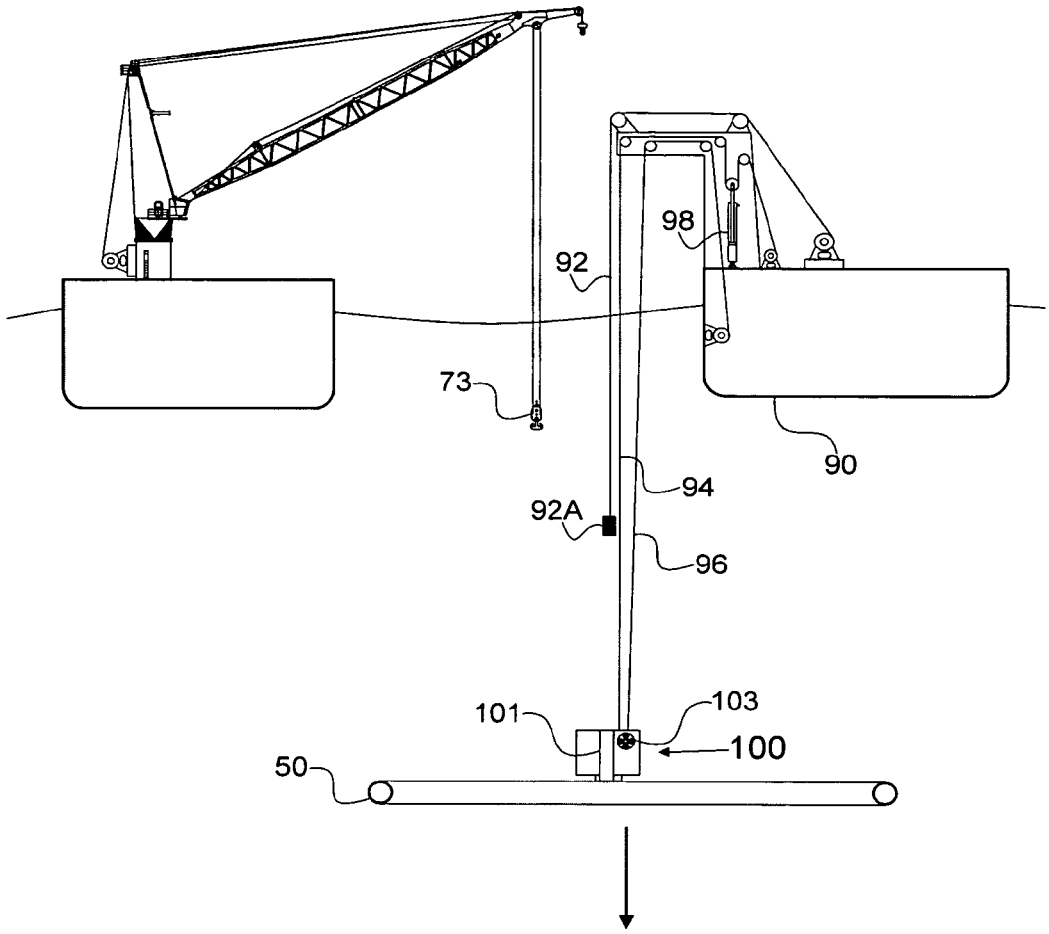

In reference to FIG. 5 through FIG. 7, a second embodiment of the method according to the second aspect of the invention is depicted.

In FIG. 5 through FIG. 7, the vessel 70 is shown. A template 50 is suspended from the first template suspension cable 72 in a suitable beneath water surface position.

Figure 8:
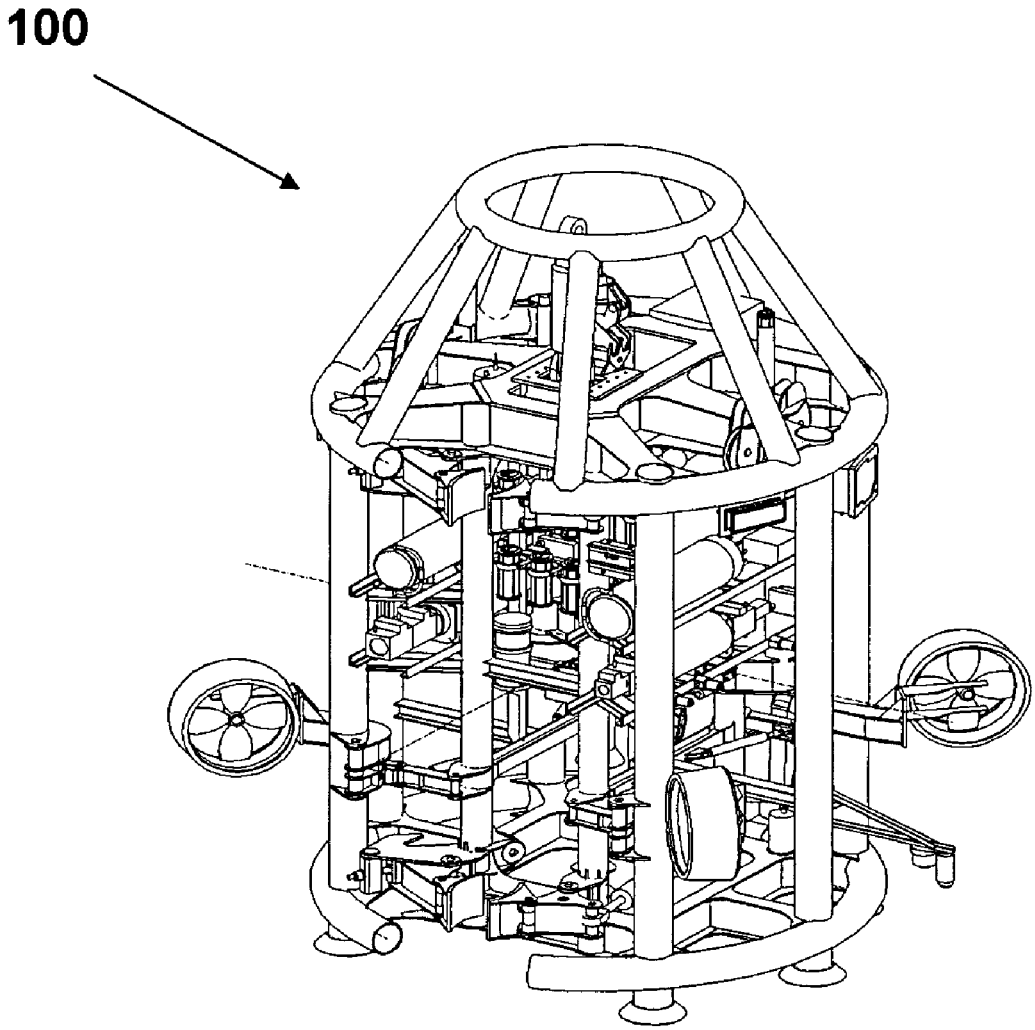
FIG. 8 depicts a perspective view of an embodiment of the ROV.

In the method, an ROV 100 (of which a preferred embodiment is shown in FIG. 8) having at least one thruster 103 is used. The thruster 103 can provide lateral thrust underwater.

The figures also depict a second vessel 90 having a crane arrangement 91 including a second template suspension cable 92, an associated template winch 93, an ROV suspension cable 94, distinct from the second object suspension cable 92 and an ROV cable winch 95.

The ROV umbilical 96 extends between the ROV 100 and ROV control system on the vessel 90. An umbilical winch 97 is also provided.

As seen in FIG. 5, the template 50 is suspended from crane 74 using first template suspension cable 72. A second template suspension cable 92 is also connected to the template 50, preferably above the center of gravity of the template 50. This connection with the second cable 92 could be made before lowering the template 50 into the water (as is preferred), but also when the template 50 is submerged, such as below the wave action zone. This could be done using cable handling capabilities of a second ROV 65, which is preferably tethered to ROV 100.

The second template suspension cable 92 runs through a guide passage 101 extending between the top and the bottom of the body of the ROV 100, which could be formed by a central duct 101 within the ROV body.

The ROV 100 is lowered into the water independent from the template 50 using the ROV suspension cable 94 and winch 95.

As seen in FIG. 6 the template 50 is now suspended from the second template suspension cable 92, where after the hook 73 and cable 72 are disconnected from the template 50 (see FIG. 7). In this situation, the ROV 100 is lowered onto the template 50 and connected therewith by a remote controlled connector 115 on the ROV 100.

A second template suspension cable 92 can be connected directly to the vessel at a fixed length without the need of a separate winch and still be able to lower ROV 100 onto the template 50 and connected therewith without departing from the scope of the invention.

In this example, the ROV 100 and associated connector 115, as well as ROV cable and winch, are capable of supporting the entire load formed by the template 50, which allows for the disconnection of the second template suspension cable 92 as is shown in FIG. 7. The cable 92 and/or the template 50 is provided with a releasable connector 92A for this purpose and can be operated by the ROV 100 on command. Then, only using the ROV cable 94, the combined unit is lowered towards the underwater installation site.

This approach has the advantage that only the umbilical 96 and ROV cable 94 extend all the way down. The approach prevents problems of chaffing between adjacent cables (if cable 92 was also used). Depending on the weight of the object to be lowered, the load carrying capability and the umbilical can be combined into a single integrated cable, so that only a single integrated cable is required. A coupling can be provided between the cables 94 and 96, using clamps at intervals along the cables.

The ROV cable 94 can be disconnected and the second template suspension cable 92 can be used to lower the combined unit.

As can be seen in FIG. 7, a heave compensation system 98 is present on the vessel 90, in which the system 98 acts on the ROV cable 94 in this example.

FIG. 9 shows the situation where the ROV 20 and crane 12 are used to pick up the object 1 and lower the interconnected ROV 20 and object 1 along a side of vessel 10 into the water. The extension of the crane 12 outside the vessel 10 is a limiting factor for the size of the object 1 that can be handled by the ROV 20 in this manner.

Figure 10:
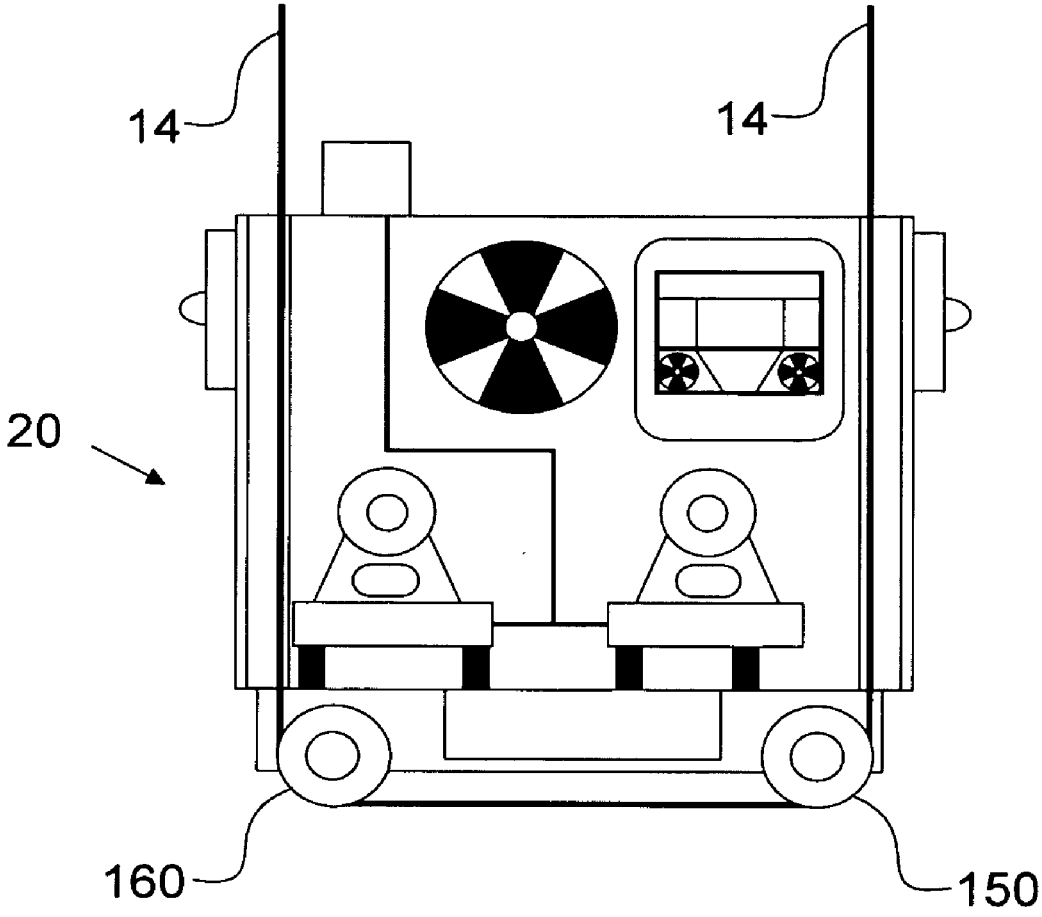
FIG. 10 depicts a schematic drawing of an alternative embodiment of an ROV which can be used with the methods according to the invention.

FIG. 10 shows an alternative ROV 20 that allows for an increase of the weight of the object to be handled with respect to an ROV suspended by a single fall ROV cable as is common.

In this alternative embodiment, the ROV 20 has a body, which body has a top, a bottom and a circumferential side. This ROV is provided with two cable guides, here formed by cable sheaves 150, 160 for the ROV suspension cable 14, which cable guides 150, 160 are placed at opposite locations near the circumferential side of the body, so that the ROV suspension cable is guided across the body. Thus the cable 14 is now used in a two fall arrangement, thereby doubling the working load. It is envisaged that one fall is connected to a fixation member on the vessel and the other fall to a winch on the vessel. It is shown here that the body of the ROV contains two vertical ducts for the cable falls, each near the circumferential side of the ROV body and extending between the top and the bottom of the body. This renders the ROV extremely stable when suspended in this manner.

Figure 11:
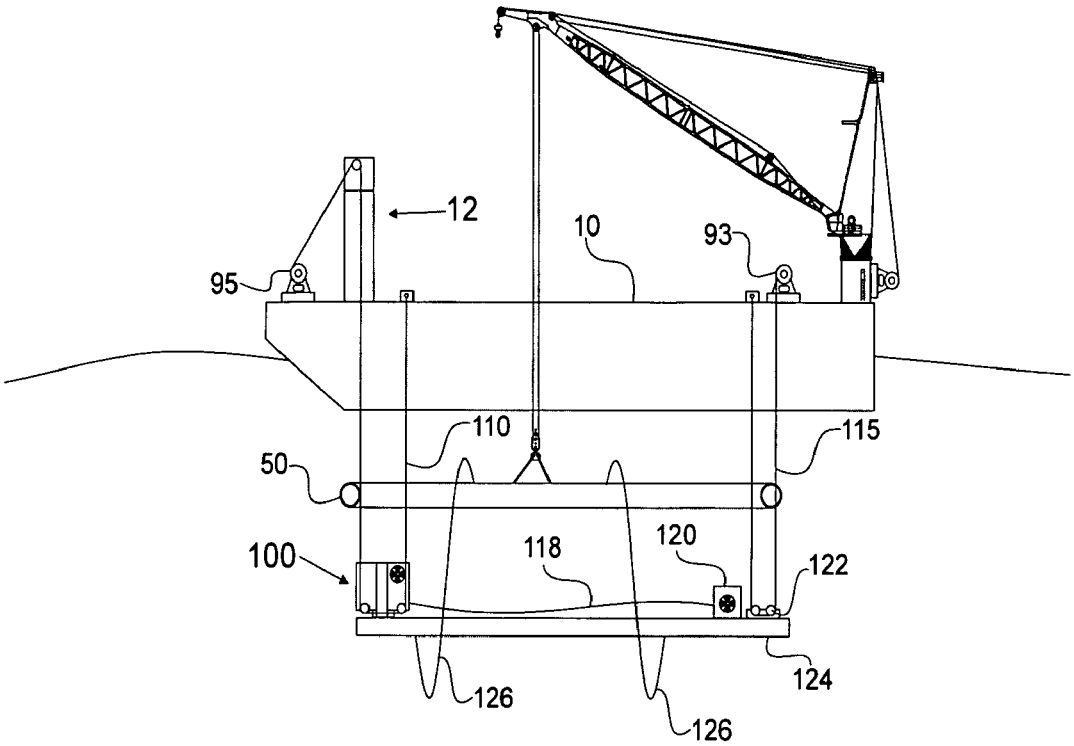
FIG. 11 depicts schematically a further embodiment of the method according to the second aspect of the invention.

A further method according to the second aspect of the invention will now be explained with reference to FIG. 11 and FIG. 12.

In this method, a submersible spreader 124 is used in combination with ROV 100 (having the double fall cable arrangement of FIG. 10) and vessel 10. The spreader 124 is an elongated load-bearing structure. The ROV 100 is interconnected to the spreader 124 and the combined spreader 124 and ROV 100 are brought into the beneath water surface position as shown in FIG. 11, which is below the vessel 10.

A spreader suspension cable 115, also in double fall arrangement, and a spreader cable winch 93 are used for suspending and lowering the spreader/ROV in combination with the ROV suspension cable 12 and ROV winch 95.

The template 50 is lowered independently into the water and then brought into a stable connection with the spreader/ROV. In FIG. 11 and FIG. 12, the crane on vessel 10 is used but it is possible/preferred that another vessel having a crane is used for lowering the object to the beneath water surface position.

Figure 12:
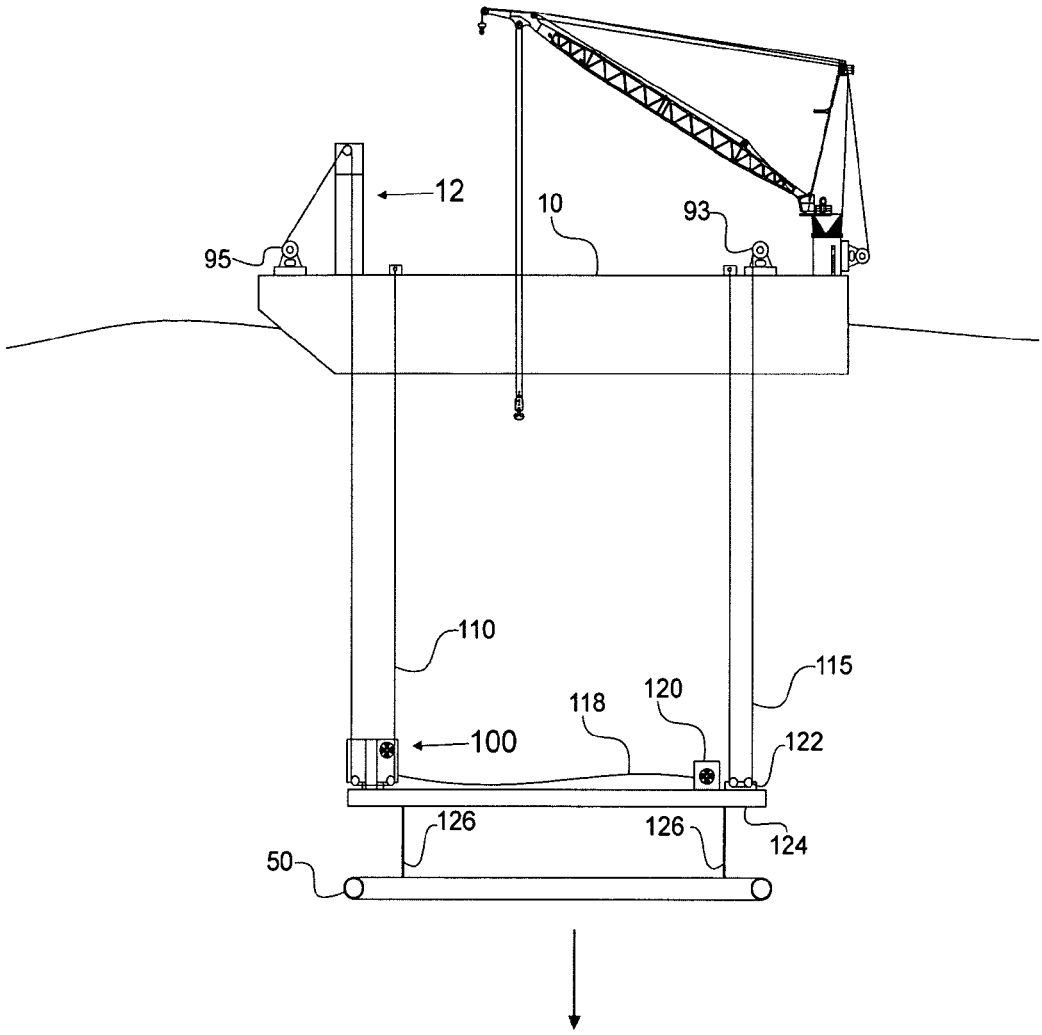
FIG. 12 depicts the method of FIG. 11 during a later stage.

As shown in FIG. 12, the connection cables 126 are used to connect the object 50 to the spreader 124, which can be done prior to lowering the object and/or the ROV/spreader into the water.

For control of the position of the spreader/ROV the spreader is provided with one or more thrusters 120. Here the ROV 100 is located near one end of the spreader 124 and the spreader suspension cable sheave(s) 122 is located near an opposite end of the spreader 124.

The thruster 120 is connected to the ROV 100 through a control and power supply line 118, so that the thruster can be controlled via the umbilical of the ROV (not shown).

As follows from FIG. 11 and FIG. 12 the template 50 is suspended from the spreader/ROV combination in the beneath water surface position, so that surface wave action does not interfere. This method allows the handling of very large and heavy objects, preferably the lowering of a 300-ton object in 3000 meters water depth.

The assembly has been described in detail with particular reference to certain preferred embodiments thereof, but it will be understood that variations and modifications can be effected within the scope of the system, especially to those skilled in the art.

The method has been described in detail with particular reference to certain preferred embodiments thereof, but it will be understood that variations and modifications can be effected within the scope of the method, especially to those skilled in the art.

What is claimed is:

1. A method for lowering an object to an underwater installation site, wherein use is made of a submersible remotely operated vehicle (ROV) comprising at least one thruster for providing at least lateral thrust, which ROV is interconnectable to the object, which method comprises:

a. providing a vessel comprising a winch and an associated suspension cable;

b. interconnecting the object and ROV;

c. lowering the interconnected object and ROV towards the underwater installation site using the suspension cable, during which the interconnected object and ROV are in a freely suspended state and lateral motion of the interconnected object and ROV is controlled using the thruster of the ROV, which lowering is continued until a holding position is reached in which the interconnected object and ROV are held suspended by the suspension cable at a distance above the installation site;

d. providing at least one anchor near the installation site;

e. interconnecting each anchor and the ROV with a positioning wire, while the ROV and object are suspended in the holding position;

f. tensioning each positioning wire and adjusting the length of each positioning wire such that the interconnected ROV and object are positioned with respect to the installation site; and g. further lowering the interconnected object and ROV which are positioned by the at least one positioning wire onto the installation site while keeping the interconnected object and ROV suspended from the suspension cable.

2. The method of claim 1, wherein multiple anchors are provided at distinct locations and each anchor is connected to the ROV using an associated positioning wire.

3. The method of claim 1, wherein the ROV is provided with a winch for each positioning wire.

4. The method of claim 3, wherein the ROV is provided with a position detection device and wherein each positioning wire winch is provided with an associated control device connected to the position detection device for controlling the operation of each positioning wire winch.

5. The method of claim 1, wherein the one or more anchors are placed such that each positioning wire is oriented essentially vertical as the interconnected object and ROV are in the holding position.

6. The method of claim 1, wherein the one or more anchors are placed such that each positioning wire is oriented essentially horizontal as the interconnected object and ROV are in the holding position.

7. The method of claim 1, wherein the anchor is a suction anchor.

8. The method of claim 1, wherein the ROV is used for placing the one or more anchors near the installation site prior to the lowering of the object.

9. The method of claim 1, wherein heave compensation system is associated with the at least one suspension cable.

10. The method of claim 1, wherein the ROV comprises a remotely operable connection device for connecting and disconnecting the object and ROV.

11. A submersible remotely operable vehicle comprising a body, a thruster, position detection device, and at least one positioning wire winch, wherein each positioning wire winch comprises a control device and each winch control device is connected to the position detection device.

12. A method for lowering an object to an underwater installation site, wherein use is made of a submersible remotely operated vehicle (ROV) comprising at least one thruster, which ROV is connectable to the object, which method comprises:

a. lowering the object into the water and suspending the object in a beneath water surface position;

b. independently from lowering and suspending the object, lowering the ROV into the water and suspending the ROV in a beneath water surface position;

c. interconnecting the object and the ROV while in the beneath water surface position; and d. further lowering the interconnected object and ROV towards the installation site.

13. The method of claim 12, wherein the beneath water surface position is beneath a wave action effect zone.

14. The method of claim 12, wherein the method further comprises the step of providing an object suspension cable and the object is lowered and suspended in the beneath water surface position using the object suspension cable, and wherein the method further comprises providing an ROV suspension cable, distinct from the object suspension cable, and wherein after interconnecting the object and ROV one of the object suspension cable and ROV suspension cable is released from the interconnected object and ROV while the other cable is used for further lowering of the interconnected object and ROV.

15. The method of claim 12, wherein the method further comprises the step of providing a first object suspension cable, and wherein the method further comprises providing a second object suspension cable, and wherein the method further comprises providing an ROV suspension cable, distinct from the first and second object suspension cables, and wherein the first and second object suspension cables are connected to the object, where after the object is lowered into the water using only the first object suspension cable, where after the object is suspended by the second object suspension cable in the beneath water surface position, wherein after interconnecting the object and ROV the first object suspension cable is released from the interconnected object and ROV while at least one of the other cables is used for further lowering of the interconnected object and ROV.

16. The method of claim 15, wherein after interconnecting the object and ROV also one of the ROV suspension cable and second object suspension cable is released from the interconnected object and ROV, while the other cable is used for further lowering of the interconnected object and ROV.

17. The method of claim 15, wherein the ROV comprises a guide passage through which the second object suspension cable is passed before the object and ROV are lowered into the water.

18. The method of claim 17, wherein the ROV comprises a body comprising a top and a bottom, wherein the ROV suspension cable is connected to the ROV top and the object is connected to the ROV bottom.

19. The method of claim 12, wherein the ROV comprises a guide passage for an object suspension cable extending between the top and the bottom of the ROV.

20. The method of claim 19, wherein the guide passage is a central duct within the ROV body.

21. The method of claim 12, wherein the method further comprises the step of providing a first vessel which carries an object winch and one object suspension cable associated with the object winch and a second vessel which carries an ROV winch and the ROV suspensiori cable associated with the ROV winch.

22. The method of claim 21, wherein the second vessel carries a second object winch and the second object suspension cable associated with the second object winch.

23. The method of claim 12, wherein a submersible spreader is used, and wherein the ROV is interconnected to the spreader, and the combined spreader and ROV are brought into the beneath water surface position, and wherein the object is lowered independently into the water and then brought into a stable connection with the spreader.

24. The method of claim 23, wherein the spreader is provided with one or more thrusters.

25. The method of claim 23, wherein a spreader suspension cable is used for suspending and lowering the spreader in combination with the ROV suspension cable.

26. The method of claim 23, wherein the object is connected to the spreader using one or more connecting cables.

27. The method of claim 23, wherein the ROV is located near one end of the spreader and a spreader suspension cable is located near an opposite end of the spreader.

28. The method of claim 23, wherein the spreader is provided with one or more thrusters, which are connected to the ROV through a control line.

29. A submersible remotely operable vehicle comprising a body, wherein the body comprises a top, a bottom and circumferential side, a thruster, a position detection device, wherein the ROV is provided with two cable guides for an ROV suspension cable, wherein the cable guides are placed at opposite locations near the circumferential side of the body, so that the ROV suspension cable is guided across the body.

* * * * *